US006369502B1

(12) United States Patent
Auber et al.

(10) Patent No.: US 6,369,502 B1
(45) Date of Patent: Apr. 9, 2002

(54) LOW PRESSURE MERCURY VAPOR DISCHARGE LAMP WITH DOPED PHOSPHOR COATING

(75) Inventors: Zsuzsa Auber; László Balázs; István Deme; Gábor Sajó; Judit Szigeti, all of Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/450,493

(22) Filed: Nov. 29, 1999

(51) Int. Cl.[7] ..... H01J 61/35
(52) U.S. Cl. ..... 313/489; 313/486; 313/635
(58) Field of Search ..... 313/485, 486, 313/489, 110, 112, 635, 639, 571, 578, 634, 493

(56) References Cited

U.S. PATENT DOCUMENTS 4,079,288 A 3/1978 Maloney et al. ..... 313/489
4,547,700 A 10/1985 Landry ..... 313/487
4,639,637 A * 1/1987 Taubner et al. ..... 313/489
5,838,100 A * 11/1998 Jansma ..... 313/485
5,869,927 A * 2/1999 Matsuo et al. ..... 313/485
6,150,757 A * 11/2000 Ronda et al. ..... 313/486

FOREIGN PATENT DOCUMENTS

JP 4110389 * 4/1992

* cited by examiner

*Primary Examiner*—Nimeshkumar D. Patel
*Assistant Examiner*—Thelma Sheree Clove

(57) ABSTRACT

A low pressure mercury vapor discharge lamp is provided, said discharge lamp (10) comprising an envelope (12) formed from light-transmitting material and containing an ionizable gas fill (22), mercury, and electrodes (18) sealed in the envelope. The envelope (12) is provided with a single layer coating (14) on the internal surface thereof next to the discharge space. The coating (14) contains halo-phosphate phosphor and 5–30 mass % aluminum oxide relative to the halo-phosphate phosphor, and the primary particle size of the aluminum oxide is smaller than 30 nanometers, the floc size of the aluminum oxide is smaller than 1 micrometer, and the void fraction of the total floc volume is at least 50%.

7 Claims, 1 Drawing Sheet

LOW PRESSURE MERCURY VAPOR DISCHARGE LAMP WITH DOPED PHOSPHOR COATING

FIELD OF THE INVENTION

This invention relates to a low pressure mercury vapor discharge lamp, and, more particularly, to a discharge lamp having a doped phosphor coating on the internal surface of the discharge envelope next to the discharge space.

BACKGROUND OF THE INVENTION

A well known unfavorable feature of low pressure discharge lamps containing ionizable gas fill and mercury vapor in a glass envelope the interior surface of which is provided with phosphor coating (e.g. fluorescent lamps) is that the luminous output is continuously decreasing during the life time of the lamp. This phenomenon originates from several root causes among which reactions taking place between the mercury vapor discharge and the phosphor coating and/or the glass play a significant role. In order to compensate mercury consumption originating from said reactions, more mercury is dosed into the discharge envelope of the lamps. This is on one hand environmentally unfriendly and on the other hand can lead to serious environmental pollution when lamps of unacceptable luminous output but still containing mercury of significant amount are processed as hazardous wastes. For this reason, efforts have been taken in lamp manufacturing for a long time to eliminate the problems of the above nature or at least abate their unfavorable consequences.

According to a resolution of the problem known for a long time and providing for a better color rendering primarily, the halo-phosphate phosphors (halo-phosphors) used earlier in the coating of discharge lamps and emitting in a wide wavelength range as a result of excitation by ultra violet irradiation are replaced by a mixture of three rare earth compounds (tri-phosphors) which emit in the green, red and blue spectral region, respectively. It was excessively experienced in the event of tri-phosphors that the depreciation of luminous output took place longer in time because on one hand the reaction between tri-phosphors and mercury took place less readily than the reaction between halo-phosphates and mercury and on the other hand the stability of the lamps with tri-phosphor coating was better due to the phosphors containing rare earth. However, the lamps with tri-phosphor coating are more expensive. For this reason, halo-phosphates are used in cheaper lamp types primarily in the event when the unfavorable features, i.e. the higher depreciation of luminous output, the shorter lamp life, the higher mercury absorption can be improved in other ways than by tri-phosphor replacement.

Several methods and protecting materials are applied for decreasing luminous output depreciation of low pressure mercury vapor discharge lamps. The most significant protecting material is aluminum oxide that improves only phosphor adhesion if it is mixed to the material of the coating in an amount of 2–4 mass % but it ensures significant protection against unfavorable interactions or reactions if applied in higher ratio or in a different form. For example according to U.S. Pat. No. 4,079,288, a protecting layer of aluminum oxide is formed on the interior surface of the glass envelope of the lamp and a phosphor coating is applied onto this layer. The depreciation of luminous output due to the interaction between mercury and glass is suppressed significantly by this method though the protective layer is not suitable for the protection of the phosphor coating. An aluminum oxide layer is deposited upon the surface of the phosphor layer in order to accomplish the protection thereof as described in U.S. Pat. Nos. 4,639, 637. 4,547,700 describes a lamp construction in which a protective layer of tri-phosphor is deposited upon the surface of halo-phosphate layer. Though the depreciation of luminous output can be significantly decreased by these methods, it is rather cost-effective and economically disadvantageous to provide two different protecting layers. Based on U.S. Pat. Nos. 4,639, 637 and 4,547,700, where gamma aluminum oxide is applied, it can be established that the protecting layer significantly decreases the initial luminous output in the 0–100 hour operation range, and only the further decrease of luminous output is moderated considerably. The initial luminous output is increased by using a special UV-reflective aluminum oxide layer as described in U.S. Pat. No. 4,079, 288, however it is established that the higher the initial luminous output the less moderate its decrease in time.

According to U.S. Pat. No. 5,838,100, no separate protective layer is applied but at least 20 mass % of aluminum oxide is mixed to the material of the phosphor coating. The aluminum oxide applied consists of UV-reflective alpha-aluminum oxide to which maximum 50 mass %, preferably about 30 mass % gamma-aluminum oxide is mixed. Although the phosphor coating can be of or may contain halo-phosphate, tri-phosphors are preferably used. Disadvantages originating from the deposit of two separate layers are eliminated by this method, and, as the data published in the description prove, conventionally thin tri-phosphor layers increase the initial luminous output when a layer of certain thickness is deposited or less amount of tri-phosphor is needed in order to accomplish a certain starting luminous output. According to the above patent specification, the depreciation of luminous output is also decreased but the inventors did not report measurement data referring to this.

We have attempted to apply the method described in the above patent to lamps provided with halo-phosphate phosphor coating that is significantly less expensive. It has been experienced however that lamps of proper initial luminous output provided with halo-phosphate phosphor coating cannot be made by the above method. In order to accomplish a certain initial luminous output, significantly thicker halo-phosphate coating has to be provided than in the event of tri-phosphors, and the referred aluminum oxide does not improve but significantly decreases the initial luminous output at this coating thickness (usual coating weight 2.5–6 $mg/cm^2$).

It is therefore seen to be desirable to improve the halo-phosphate phosphor coating in low pressure mercury vapor discharge lamps by applying one single suitably doped layer so that the depreciation in luminous output during the life of the lamp is significantly moderated and simultaneously the quantity of mercury to be dosed into these lamps is decreased while the decrease in initial luminous output is kept at a low level.

BRIEF SUMMARY OF THE INVENTION

A low pressure mercury vapor discharge lamp is provided, said discharge lamp comprising an envelope formed from light-transmitting material and containing an ionizable gas fill, mercury, and electrodes sealed in the envelope. The envelope is provided with a single layer coating on the internal surface thereof next to the discharge space. The coating contains halo-phosphate phosphor and 5–30 mass % aluminum oxide relative to the halo-phosphate phosphor, and the primary particle size of the aluminum oxide is smaller than 30 nanometers, the floc size of the aluminum oxide is smaller than 1 micrometer, and the void fraction of the total floc volume is at least 50%.

The precise selection of the type of aluminum oxide has primary importance as the above exhibit shows. The applied aluminum oxides are similar to those described in U.S. Pat. Nos. 4,639,637 and 4,547,700. Although it is known from the specifications of these patents that the application of said aluminum oxides as a separate layer decreases the initial luminous output of the lamps considerably, we have found surprisingly that such aluminum oxides mixed directly to the material of the halo-phosphate phosphor layer decrease the initial luminous output of the lamp only slightly. Simultaneously, the depreciation in luminous output during the life of the lamp is close to this characteristic of the lamps provided with tri-phosphor coating. In addition to these primary advantages of the present invention, the quantity of mercury to be dosed into the lamp is decreased.

BRIEF DESCRIPTION OF THE DRAWING

In the following detailed description, references will be made also to the attached drawing in which.

DETAILED DESCRIPTION OF THE INVENTION

Figure 1:
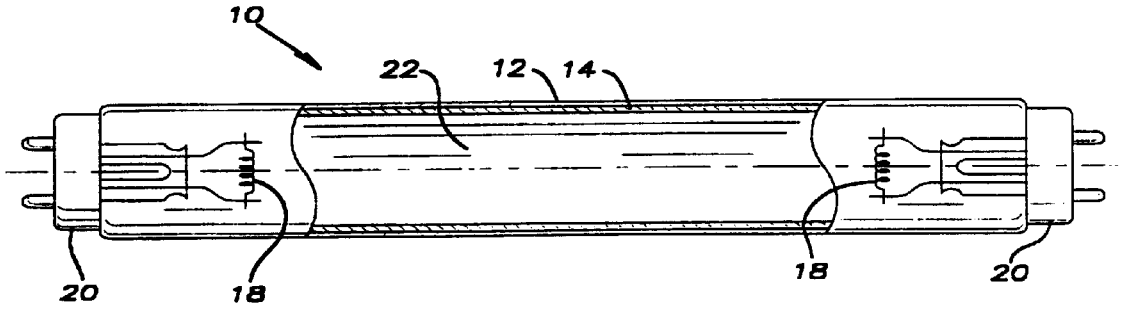
FIG. 1 shows diagrammaticaly, and partly in section, a fluorescent lamp in which the present invention is embodied.

FIG. 1 shows a representative low pressure mercury vapor discharge lamp 10, which is generally well-known in the art. The lamp 10 has an envelope 12 which is formed from a light-transmitting material, preferably from glass. The internal surface of the glass envelope 12 is provided with a single coating 14.

The lamp 10 is hermetically sealed by bases 20 attached at both ends, and a pair of spaced electrodes 18 are respectively mounted on the bases 20. An ionizable gas fill 22 of mercury and an inert gas is sealed inside the envelope 12. The inert gas is typically krypton or argon or a mixture of the two and other noble gases at low pressure which, in combination with a small quantity of mercury, provided the low vapor pressure manner of operation.

The single coating 14 on the internal surface of the glass envelope 12 contains halo-phosphate phosphor. The primary particle size of the aluminum oxide is smaller than 30 nanometers, the floc size of the aluminum oxide is smaller than 1 micrometer, and the void fraction of the total floc volume is at least 50%.

These types of aluminum oxides are characteristically gamma aluminum oxides mixed optionally with some amount of delta aluminum oxide and/or beta aluminum oxide. Outstanding result have been accomplished by using the C-type aluminum oxide made by the Degussa Company, referred to as Degussa C further on. A significant physical characteristic of the applied aluminum oxide is that it does not show UV-reflective effect. This aluminum oxide rather exerts an antireflective effect unlike the aluminum oxide type described in U.S. Pat. Nos. 4,079,288 and 5,838,100.

The amount of aluminum oxide applied in the coating 14 is preferably 10–25 mass % or more preferably 15–22 mass % relative to the halo-phosphate phosphor. The halo-phosphate phosphor in the coating 14 can be of any mixture of any halo-phosphates used in the art for this purpose. The coating 14 may contain optionally other phosphor compounds, as well. Though the application of tri-phosphors is not excluded, their application is disadvantageous from economic point of view and does not represent a particular advantage in respect of the improvement of parameters examined.

A material suitable for making a coating described above that contains halo-phosphate phosphor and aluminum oxide in 5–30 mass % (preferably in 10–25 mass %) relative to the mass of halo-phosphate phosphor in the form of water suspension, optionally also contains one or more suspension forming agents and/or agents promoting deposition and/or other additives which can be as follows: dispersion agents (preferably anionic or non-ionic dispersion agents), binding materials (preferably polyethylene-oxides), film-forming additives, wetting agents and antifoam agents. These materials are well known in the art.

The coating was formed on the internal surface of the discharge envelope 12 using the technology described in the cited or other patent specifications. The thickness of the coating (considered dry material only) is usually 2.5–6 mg/cm$^2$, preferable 3–5 mg/cm$^2$.

Applying the technical solution of the present invention, the initial luminous output of a lamp is only moderately decreased compared to the initial luminous output of a lamp with a coating containing the same amount and quality of halo-phosphate phosphor and in addition 3 mass % of aluminum oxide sufficient only for the increase of adhesion. However, the lamp, in which the present invention is embodied, provides a luminous output that reaches 90–95% of its initial luminous output measured after 100 hour burning time even after 10 000 hour operation. This value is close to the luminous output of lamps provided with tri-phosphor coating and significantly higher than the identical value of conventional discharge lamps which is about 80%. Such a significant reduction of luminous output depreciation makes possible that the mercury content of low pressure mercury vapor discharge lamps is decreased to less than 10 mg, preferably 4–8 mg from 10–15 mg relating to an envelope length of 1.2 meter which is advantageous from environmental and health protection points of view.

Further details of the present invention will be illustrated by examples.

EXAMPLE 1

A coating was provided on the internal surface of the glass envelope of a 36W T8 type linear fluorescent lamp. An amount of coating corresponding to a dry mass of 3.5 g/bulb (about 3.5 mg/cm$^2$) was deposited from a water suspension containing warm white halo-phosphor, 20% Degussa C aluminum oxide, 2.5% Dispex A-40 (ammonium salt of poly-acrylic acid, made by Allied Colloids Co.) and 3% of poly-ethylene-oxide of 3000 molar mass (the percentages relate to the mass of halo-phosphate phosphor). Lamps were produced by conventional technology using the glass envelopes provided with the coating. A mixture of 75% krypton and 25% argon with a pressure of 2.93 mbar was used as fill gas and 8 mg mercury was dosed in the glass envelopes having a length of 1.2 meter. The average luminous output of 25 test lamps described above was 2500 lumens after 7500 hours of operation in contrast to 2170 lumens provided by test lamps containing only 3 mass % of Degussa C aluminum oxide in the coating thereof.

EXAMPLE 2

A coating was provided on the internal surface of the glass envelope of a 18W T8 type linear fluorescent lamp. An amount of coating corresponding to a dry mass of 3.5 g/bulb (about 3.5 mg/cm$^2$) was deposited from a water suspension containing warm white halo-phosphor, 20% Degussa C aluminum oxide, 2.5% Dispex A-40 (ammonium salt of poly-acrylic acid, made by Allied Colloids Co.) and 3% of poly-ethylene-oxide of 3000 molar mass (the percentages relate to the mass of halo-phosphate phosphor). Lamps were produced by conventional technology using the glass envelopes provided with the coating. A mixture of 75% krypton and 25% argon with a pressure of 2.93 mbar was used as fill gas and 4 mg mercury was dosed in the glass envelopes having a length of 0.6 meter. The average luminous output of 25 test lamps described above was 940 lumens after 10 000 hours of operation in contrast to 860 lumens provided by test lamps containing only 3 mass % of Degussa C aluminum oxide in the coating thereof.

What is claimed is:

1. A low pressure mercury vapor discharge lamp (10) comprising an envelope (12) formed from light-transmitting material and containing an ionizable gas fill (22), mercury, and electrodes (18) sealed in the envelope; the envelope (12) having a single layer coating (14) on the internal surface thereof next to the discharge space; the coating (14) containing halo-phosphate phosphor and 5–30 mass % aluminum oxide relative to the halo-phosphate phosphor; and the aluminum oxide having a primary particle size smaller than 30 nanometers, a floc size smaller than 1 micrometer; and the void fraction of the total floc volume being at least 50%.

2. The discharge lamp of claim 1 in which the coating (14) contains 10–25 mass % aluminum oxide relative to the halo-phosphate phosphor.

3. The discharge lamp of claim 2 in which the coating (14) contains 15–22 mass % aluminum oxide relative to the halo-phosphate phosphor.

4. The discharge lamp of claim 1 in which the aluminum oxide content of coating (14) is in the form of gamma aluminum oxide.

5. The discharge lamp of claim 1 in which the aluminum oxide content of the coating (14) is in the form of Degussa C aluminum oxide.

6. The discharge lamp of claim 1 in which the mercury content is less than 10 mg relating to an envelope length of 1.2 meter.

7. The discharge lamp of claim 6 in which the mercury content is 4–8 mg relating to an envelope length of 1.2 meter.

* * * * *